US005149293A

United States Patent [19]

Gable

[11] Patent Number: 5,149,293

[45] Date of Patent: Sep. 22, 1992

[54] BRASSIERE ACCESSORY

[76] Inventor: Lisa Gable, 719 St. James Pl. #419, East Windsor, N.J. 08561

[21] Appl. No.: 800,485

[22] Filed: Nov. 29, 1991

[51] Int. Cl.[5] ..... A41C 3/12; A41F 1/00; A41F 1/04; A41F 17/00

[52] U.S. Cl. ..... 450/86; 2/338; 2/101; 450/1

[58] Field of Search ..... 2/73, 101, 303, 306, 2/338, 340; 450/73, 78, 79, 80, 86, 87

[56] References Cited

U.S. PATENT DOCUMENTS

| | | | |
|---|---|---|---|
| 1,410,306 | 3/1922 | Hoffmann | 128/507 |
| 1,478,773 | 12/1923 | Stocker | 128/510 |
| 2,462,161 | 2/1949 | Callis | 2/303 |
| 2,542,881 | 2/1951 | Ries | 450/73 X |
| 2,975,432 | 3/1961 | Johnson | 2/306 |
| 3,008,468 | 11/1961 | Williams | 450/86 X |
| 3,027,898 | 4/1962 | Williams | 450/86 |
| 3,179,109 | 4/1965 | Bern | 128/507 |
| 3,465,754 | 9/1969 | Lockwood et al. | 450/86 X |
| 4,220,157 | 9/1980 | Clark et al. | 450/86 |
| 4,401,227 | 12/1921 | Wyeth | 128/507 |
| 4,612,935 | 9/1986 | Griefer | 128/510 |
| 4,894,868 | 1/1990 | Christopher | 450/86 X |
| 5,024,628 | 6/1991 | Sanchez | 450/86 X |

FOREIGN PATENT DOCUMENTS

| | | | |
|---|---|---|---|
| 0914101 | 9/1946 | France | 450/87 |
| 0436720 | 10/1935 | United Kingdom | 450/86 |
| 0553610 | 5/1943 | United Kingdom | 450/86 |

*Primary Examiner*—Werner H. Schroeder
*Assistant Examiner*—Jeanette E. Chapman
*Attorney, Agent, or Firm*—Birgit E. Morris

[57] ABSTRACT

A brassiere accessory comprises two elongated bands that can be fastened together at one end and is threaded through a grip means at the other end, said grip means having two slot openings for passage therethrough of a shoulder strap of a brassiere, and serrated edges opposite said slot openings for gripping said shoulder straps, and an arcuate opening through which an elongated band is threaded. The elongated bands can be fitted with length adjusting means.

6 Claims, 2 Drawing Sheets

BRASSIERE ACCESSORY

This invention relates to an accessory for a brassiere. More particularly this invention relates to a brassiere accessory that maintains the brassiere shoulder straps in a relatively fixed position.

BACKGROUND OF THE INVENTION

Conventional brassieres comprise a pair of breast cups affixed to a bandeau that surrounds the chest and can be fastened either at the front or the back. A pair of shoulder straps are affixed to the top of the breast cups and along the back of the bandeau. The shoulder straps are generally adjustable in length to conform to the size of the wearer, either by making them of elasticized fabric or by means of an adjustable buckle.

One of the biggest problems with conventional brassieres is that the shoulder straps tend to slip downwardly off the shoulders of a wearer. Several suggestions for solving this problem have been presented heretofore. The straps can be tightened to prevent them from slipping off the shoulder, but this method is not always successful and the straps tend to dig into the shoulder as well, discomforting the wearer. Others have suggested various means of holding the shoulder straps together at the back. For example, Stocker U.S. Pat. No. 1,478,773 and Greifer U.S. Pat. No. 4,612,935 disclose a retaining band or tie to hold the straps together at the back. This method distorts the brassiere and, since it is situate above the back of the bandeau, is too high to be fastened or adjusted at the back by the wearer while the brassiere is being worn. Thus the Stocker and Greifer ties requires an added fastening step by the wearer while the brassiere is off, which may have to be repeated until a proper fit and comfort level is obtained. Alternatively, another person must perform the adjustments.

Thus a means of preventing the shoulder straps from slipping down the shoulders, but without adding bulk or discomfort, and that can be attached easily and quickly while the brassiere is being worn, is highly desirable.

SUMMARY OF THE INVENTION

The brassiere accessory of the invention comprises two elongated bands that can be fastened together at one end and fastened to the shoulder straps of a brassiere at the other end using a unique fastening means that provides attachment to the shoulder strap of the brassiere without bunching or distorting the shoulder strap or the band with movement of the wearer.

While being worn, the elongated bands are each attached to a shoulder strap by the fastening means, criss crossed around the back and fastened together at the front.

DETAILED DESCRIPTION OF THE INVENTION

Figure 1:
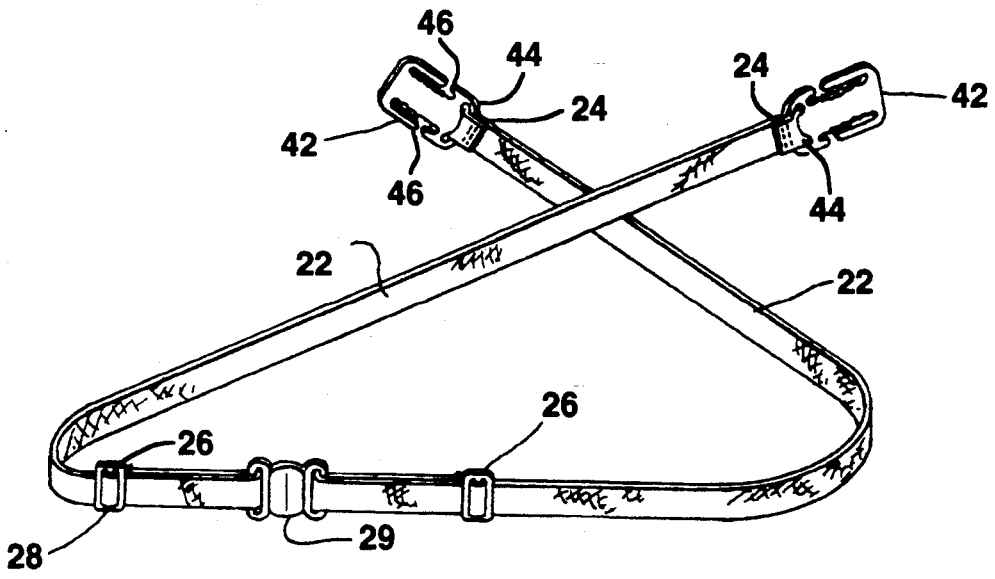
FIG. 1 is a perspective view of a brassiere accessory band of the invention.

The brassiere accessory of the invention is shown in FIG. 1. A pair of elongated bands or strips 22, which can be made for example of woven or nonwoven fabric, ribbon and the like, have a tab grip 42 at one end 24 thereof. Each elongated band 22 is permanently attached to the tab grip 42, as by threading each end 24 of the band 22 through an opening 44 in the tab grip 42, thereby forming a loop and sewing, bonding or otherwise permanently fastening the end 24 to the band 22. The band 22 is threaded at its other end 26 by a slide 28 that can be slidably adjusted to adjust the total length of the band 22 to match the girth of the wearer. A snap closure 29 is threaded onto the band 22.

Figure 2:
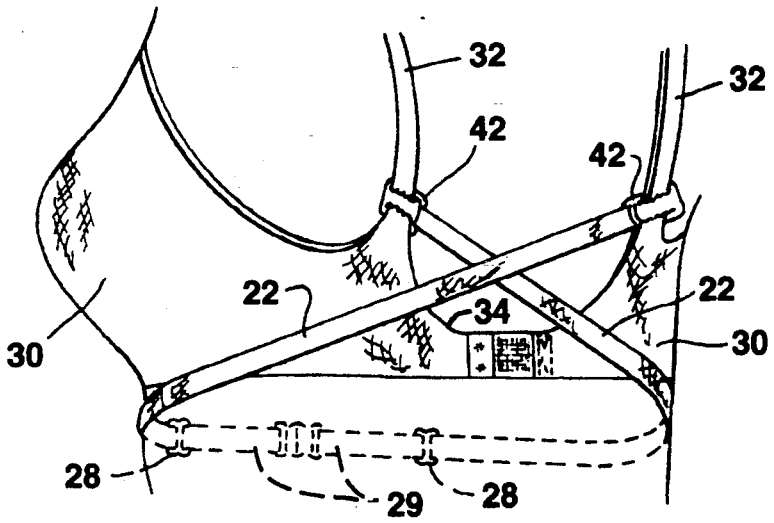
FIG. 2 is a rear perspective view showing a conventional brassiere to which the band of the invention is attached.
Figure 3:
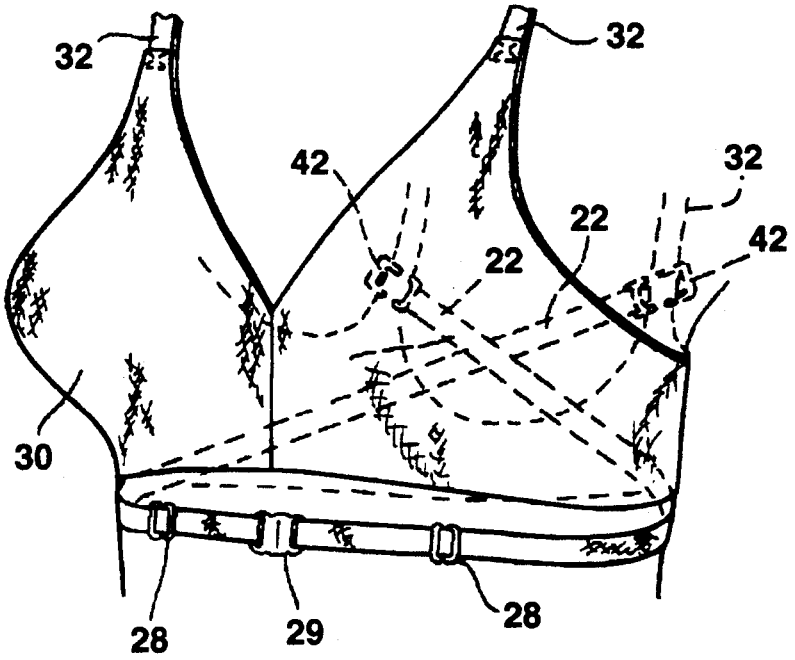
FIG. 3 is a front perspective view showing a conventional brassiere to which the band of the invention is attached.
Figure 4:
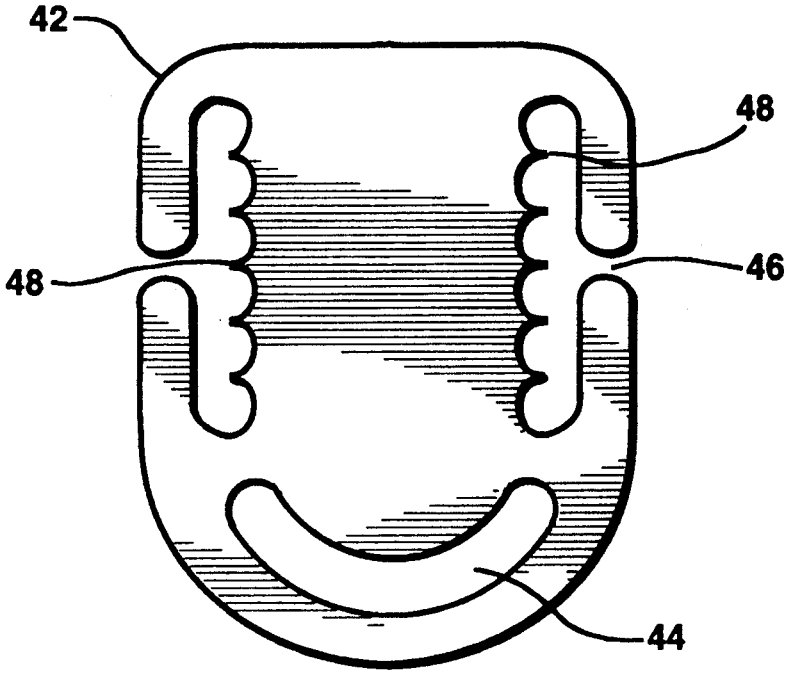
FIG. 4 is an enlarged view of a grip of the invention for attaching the band of the invention to the shoulder strap of a conventional brassiere.

One of the unique features of the tab grip 42 is the shape of the opening 44. FIG. 4 is an enlarged view of the tab grip 42. The opening 44 is arcuate, which allows slidable and automatic adjustment of the band 22 with respect to a brassiere 3 shoulder strap 32 to which the band 22 is attached, as seen in FIGS. 2 and 3. The arcuate opening 44 is wider than the band 22 and allows for relative movement along the arc by the band 22 in accordance with the movements of the wearer. This adjustment maximizes the comfort of the wearer. The tab grip 42 has slot openings 46 to allow feedthrough of a shoulder strap 32. Serrated portions 48 opposite the slot openings 46 of the tab 42 grip the shoulder strap 32 and allow removable engagement and adjustment of the position of the band 22 with respect to the shoulder strap 32 as shown in FIG. 2.

To use the band 22 of the invention, the wearer first attaches the elongated band 22 to the brassiere by inserting the shoulder straps 32 into the slot openings 46 of the tab 42. The elongated band 22 is preferably positioned along the shoulder straps 32 near the bandeau 34 of the brassiere, but the position of the band 22 along the shoulder strap 32 can be adjusted to a different position by the wearer as desired.

The brassiere 30 is then put on in normal fashion. The band 22 is then criss crossed at the back and brought to the front of the wearer and the snap closure 29 is fastened. Adjustment of the slides 28 can be made in conventional manner to shorten or lengthen the band 22. The band 22 does not need to be fitted snugly or tightly in order to prevent the shoulder straps 32 of the brassiere 30 from sliding from the shoulders of the wearer. The unique arcuate opening 44 of the tab 42 allows automatic adjustment of the strap 22 with varying movements of the wearer, and also provides a means of keeping the band 22 flat against the wearer, so as to avoid bunching of the band 22. This feature also ensures that the band 22 remains invisible outside of the exterior clothing of the wearer.

The tab grips, slides and snap fasteners can be made of any rigid or semirigid material, such as metal, plastic and the like. The snap closure 29 can be substituted by other conventional fasteners such as hooks and eyes, interlocking buckles, Velcro tabs and the like, as will be known to one skilled in the art.

Although the invention has been described by means of certain materials and adjustment means, other materials and means may be substituted and the invention is meant only to be limited by the appended claims.

I claim:

1. A brassiere accessory comprising two elongated bands having fastening means at each end thereof to connect the same together and grip tabs at each of the other ends thereof, each grip tab having a pair of slot openings to allow passage therethrough of a brassiere shoulder strap and a serrated edge opposite said slot openings for gripping said shoulder strap, and an arcuate opening through which each of the ends of the elongated bands is threaded.

2. An accessory according to claim 1 wherein said elongated bands are adjustable in length.

3. An accessory according to claim 2 wherein length adjusting means is attached near said fastening means.

4. An accessory according to claim 1 wherein said fastening means is a snap closure means.

5. A method of preventing the shoulder straps of a brassiere from sliding off the shoulders of a wearer which comprises, in sequence:

inserting each shoulder strap into a tab grip comprising a pair of slot openings, a serrated edge opposite said slot openings and an arcuate opening into which an elongated band is threaded and fastened, putting on and fastening the brassiere;

criss crossing the elongated bands across the back of the wearer, bringing the elongated bands to the front of the wearer, and fastening the ends of the elongated bands to each other.

6. A method according to claim 5 including the step of adjusting the length of the elongated bands.

* * * * *